US005111971A

United States Patent [19]

Winer

[11] Patent Number: 5,111,971

[45] Date of Patent: May 12, 1992

[54] SELF-PRESSURIZED CONTAINER HAVING A CONVOLUTED LINER AND AN ELASTOMERIC SLEEVE

[76] Inventor: Robert Winer, 2290 Thurmont Rd., Akron, Ohio 44313

[21] Appl. No.: 646,621

[22] PCT Filed: May 25, 1990

[86] PCT No.: PCT/US90/03062

§ 371 Date: Jan. 28, 1991

§ 102(e) Date: Jan. 28, 1991

[87] PCT Pub. No.: WO90/14284

PCT Pub. Date: Nov. 29, 1990

Related U.S. Application Data

[63] Continuation-in-part of Ser. No. 358,392, May 26, 1989, abandoned.

[51] Int. Cl.[5] ..... B65D 35/28

[52] U.S. Cl. ..... 222/95; 222/105; 222/183; 222/386.5; 29/888.01

[58] Field of Search ..... 222/95, 105, 386.5, 222/183, 405, 402.1, 402.26; 29/888.01

[56] References Cited

U.S. PATENT DOCUMENTS

| | | | |
|---|---|---|---|
| 3,097,766 | 7/1963 | Biehl et al. | 222/135 |
| 3,700,136 | 10/1972 | Ruekberg | 220/460 |
| 3,731,854 | 5/1973 | Casey | 222/95 X |
| 4,121,737 | 10/1978 | Kain | 222/95 |
| 4,222,499 | 9/1980 | Lee et al. | 222/386.5 X |
| 4,251,032 | 2/1981 | Werding | 222/386.5 X |
| 4,324,350 | 4/1982 | Thompson | 222/386.5 X |
| 4,387,833 | 4/1983 | Venus | 222/95 |
| 4,423,829 | 3/1984 | Katz | 222/95 |
| 4,560,085 | 12/1985 | Von Hofe et al. | 222/180 X |
| 4,964,540 | 10/1990 | Katz | 222/95 |

FOREIGN PATENT DOCUMENTS

| | | | |
|---|---|---|---|
| 0178573 | 4/1986 | European Pat. Off. | 222/95 |
| 63-294378 | 12/1981 | Japan . | |
| 0267181 | 10/1989 | Japan | 222/386.5 |
| 2153011 | 8/1985 | United Kingdom | 222/105 |

*Primary Examiner*—Michael S. Huppert
*Assistant Examiner*—Kenneth DeRosa

[57] ABSTRACT

Self-pressurized container which comprises a liner/-sleeve assembly containing a thin, flexible radially expandable convoluted plastic liner, about 0.010 to about 0.020 inch think, inside an essentially cylindrical elastomeric sleeve. The liner is generally cylindrical, open at one end and closed at the other end, and comprises an outwardly turned flange and an upper sidewall adjacent to the open end and a convoluted portion comprising longitudinally extending convolutions which extend from the upper sidewall towards the closed end. The liner is formed in the convoluted state, and has memory so that it returns to the convoluted state when unstressed. The outside diameter of the liner, measured between diametrically opposite peaks of the convolutions when the liner is unstressed, exceeds the inside diameter of the elastomeric sleeve when unstressed. Both liner and sleeve expand radially outwardly when the liner is filled under pressure with product to be dispensed. The liner/sleeve assembly is capable of holding a substantial quantity of fluid product and of causing substantially all of said product to be dispensed. The top assembly of the container is similar to that of a conventional aerosol container, comprising a valve assembly with a metallic cup whose rim is crimped around a ring surrounding a central opening of a metallic dome, but with a part of the upper sidewall of the liner clamped between the cup and the dome ring as a gasket to form a fluid tight closure for the liner.

18 Claims, 2 Drawing Sheets

SELF-PRESSURIZED CONTAINER HAVING A CONVOLUTED LINER AND AN ELASTOMERIC SLEEVE

CROSS REFERENCE TO RELATED APPLICATION

Applicant under 35 USC 120 and 35 USC 365(c) claims the benefit of the filing dates of earlier copending U.S. application Ser. No. 07/358,392, filed May 26, 1989 now abandoned and earlier copending PCT International application PCT/US90/03062, filed May 25, 1990, which designates the United States. This application is a continuation-in-part of both earlier applications.

TECHNICAL FIELD

This invention relates to self-pressurized containers for containing and dispensing of fluid materials.

BACKGROUND ART

Aerosol containers for containing and dispensing of fluid materials are well known and widely used. Products sold in aerosol containers include, for example, foods such as whipped cream; toiletries such as shaving cream, deodorant and hair spray; and paints, just to name a few. Dispensing is accomplished with the aid of a propellant under pressure. Aerosol containers offer the advantages of convenience and nearly complete dispensing of the fluid product material from the container. Disadvantages of aerosol container include their limited operating temperature range and the fact the container must be held upright to dispense properly.

A major concern over aerosol containers is the fact that the propellants used and the pressures required present environmental hazards. Aerosol cans fall into one of two categories as follows: 1) where the product and the propellant mix, which is a standard aerosol container and 2) where the product and the propellant are kept separated and that is known as a barrier pack. One of the concerns that exists with the barrier pack container is that propellant is locked into the container after the product has been expelled, creating an extreme hazard in the incineration of that type of container because a cloud of propellant can be formed if too many containers are crushed at the same time creating an explosive situation. A point of fact is that the Recycle Energy plant in Akron, Ohio has had several explosions due to too many of the barrier pack aerosols being crushed prior to incineration.

One of the principal classes of propellants are the fluorocarbons and chlorofluorocarbons (CFCs). Recent environmental concern regarding the use of these materials, and particularly the harmful effect on the ozone layer of the upper atmosphere, has prompted a search for replacement. In fact, some major manufacturers of these materials have pledged to phase out their production over the next decade or so. Another class of propellants are hydrocarbons, particularly the liquified petroleum gas (LPG) hydrocarbons such as butane and pentane. While these do not tend to deplete the ozone layer (as far as is known), they do present other hazards because of their flammability. Also, there are certain hazards in filling, transporting, storing and incineration of aerosol containers because of the high pressure required, no matter what propellant is used. These hazards are reflected in terms of costs, e.g., safety precautions in filling and handling, insurance costs, etc.

Self-pressurized containers have been suggested as an alternative to aerosol containers. Representative self-pressurized containers include those shown and described in U.S. Pat. No. 4,387,833 to Venus, Jr. and 4,423,829 to Katz. These references, which are rather similar in their teachings, describe apparatus for containing and dispensing of fluids under pressure in which no propellant is used and in which the fluid material to be dispensed is contained in a flexible plastic liner which in turn is contained in (from the inside out) a fabric sleeve and an elastomeric sleeve, which surround the liner except for a small neck portion at the top. The liner (except for the neck portion) has a plurality of longitudinally extending folds. When the liner is filled under pressure with the desired product, the entire assembly expands radially. The liner, which has a star shaped configuration when folded and not under pressure, is nearly circular in cross section when fully expanded. The elastomeric sleeve stores energy as a result of its radial expansion. This stored energy in the sleeve causes fluid to be dispensed upon opening of the dispensing valve. The container assembly contracts radially and the liner becomes folded, as it is emptied.

A disadvantage of self-pressurized containers of this sort is that an appreciable quantity of product remains inside the liner when it has been emptied as far as possible. This, of course, is costly. This may be attributable to the fact that the liners in the Venus and Katz structures are formed (e.g., by blow molding) in a smooth, essentially cylindrical configuration, and the folds or creases are then formed afterward. Since the preferred plastic materials have "memory", the liner seeks to return to the shape in which it is formed and resists becoming completely folded, which is essential to substantially complete expulsion of the product.

A further disadvantage of the Venus and Katz structures lies in the valve assembly at the top of the container. In this valve assembly, a cylindrical wall of a valve body is joined solely to the neck portion of the liner, with no additional support structure.

The neck portion of the liner is made thicker than the rest of the liner and is designed to use only one valve assembly.

DISCLOSURE OF THE INVENTION

This invention according to one aspect thereof provides a reusable and recyclable, self-pressurized container comprising:

(a) a radially expandable generally cylindrical flexible plastic liner open at one end and closed at the other end, said liner being of sufficient thickness to be self-supporting in the unstressed state and having upper sidewall means adjacent to the open end and regularly convoluted portion comprising a plurality of longitudinally extending convolutions extending from upper sidewall means toward the closed end, said liner having an outwardly turned flange at the open end thereof;

(b) an essentially cylindrical elastomeric sleeve open at both ends and surrounding at least a major portion of the liner in tight-fitting relationship, the normal inside diameter of said sleeve being substantially smaller than the exterior diameter of the liner in its folded state; and (c) a housing comprising a sidewall and an essentially rigid annular dome, said dome having a central opening and a ring surrounding said opening; and (d) a valve assembly including a valve for dispensing fluid material from the interior of said plastic liner, an essentially rigid cup having an upstanding sidewall, and a vertical tubular stem for discharge of said fluid material, the upper portion of the sidewall of said cup including said flange being crimped against the ring of said dome with the open end of said liner being clamped therebetween.

This invention according to another aspect thereof provides a fluid dispensing assembly for a self-pressurized container, comprising a radially expandable liner and an elastomeric sleeve surrounding the same as above described.

This invention according to a further aspect provides a method for making a self-pressurized container as above described, which comprises:

(a) molding a moldable material into a generally cylindrical self-supporting flexible liner open at one end and closed at the other end and having, as molded upper sidewall means adjacent to the open end, an outwardly turned flange at the open end and a regularly convoluted portion comprising a plurality of regularly spaced convolutions expanding longitudinally from the upper sidewall means toward the closed end;

(b) inserting said liner into an elastomeric sleeve having an inside diameter substantially smaller than the exterior diameter of the liner in its folded state and an axial length less than that of the liner, so that the upper sidewall means of the liner protrudes from the sleeve;

(c) placing an annular essentially rigid dome having a central opening and a ring encircling said opening so that said ring is in touching engagement with the outside surface of the upper sidewall means;

(d) placing a valve assembly which includes a metal cup having enough standing sidewall so that said sidewall is in contact with the inside surface of the upper sidewall means of the liner;

(e) crimping the upper edge of the sidewall means of said cup against said ring, with the part of the upper sidewall means of said liner clamped therebetween as a gasket material to form a fluid tight seal between said cup and said liner; and (f) assembling any remaining housing components to form said container.

BEST MODE FOR CARRYING OUT THE INVENTION

This invention will now be described in detail with particular reference to the best mode and preferred embodiment thereof.

Figure 1:
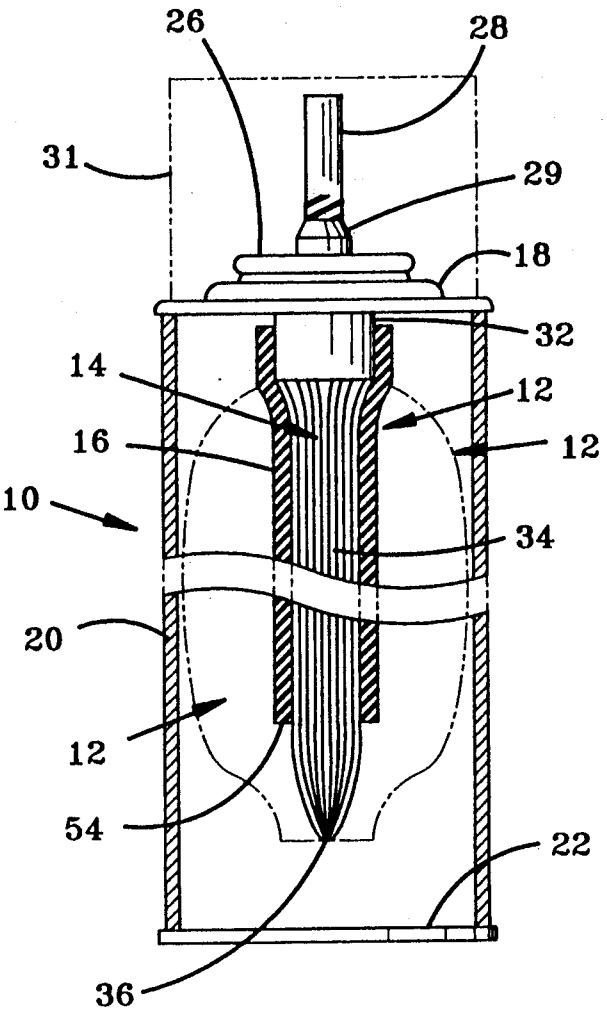
FIG. 1 is an elevational view, with parts shown in longitudinal section, of a container according to this invention.

The container of this invention as a whole is shown in FIG. 1. Referring to FIG. 1, container 10 is a self-pressurized container for dispensing of fluid materials, which comprises a fluid dispensing assembly 12 including an expandable liner 14 having a major portion which is pleated, and an elastomeric sleeve 16 surrounding a major portion of the liner in tightfitting relationship; a housing which comprises an annular dome 18, a cylindrical sidewall or outside shell 20, and a bottom wall 22; and a valve assembly 24 (see FIG. 8) which comprises a cup 26 having a central opening, a vertical tubular stem 28 extending through the central opening of cup 26 for discharge of fluid product from liner 14, a collar 29 surrounding the lower portion of stem 28 just above cup 26, a valve 30 and a cap 31 (shown in phantom lines in FIG. 1) which is optional. Valve 30 may be a conventional spring pressed reciprocating valve similar to those used in aerosol containers.

FIG. 1 shows liner 14 and sleeve 16 in their normal position, i.e., when liner 14 is empty. When liner 14 is pressurized and filled with product to be dispensed, the sleeve 16 assumes the contour shown in phantom line.

Figure 2A:
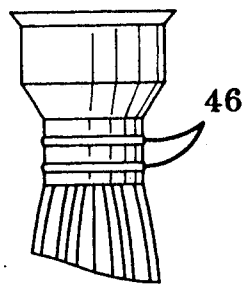
FIG. 2A is a fragmentary elevational view of a modified form of liner according to this invention in its normal or folded state.
Figure 2:
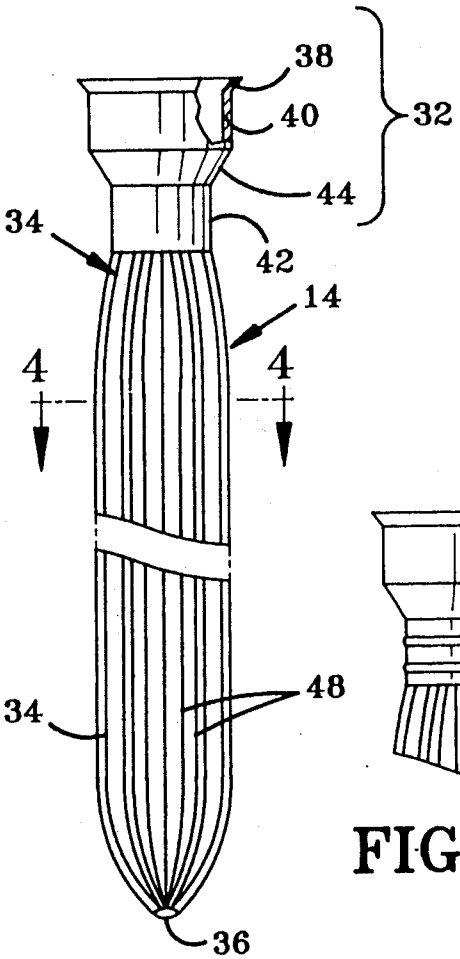
FIG. 2 is an elevational view of a liner according to this invention in its normal or folded state.

The liner 14 will now be described in detail with particular reference to FIGS. 2-5. Referring now to FIG. 2, liner 14 is an elongated, generally cylindrical, radially expandable but longitudinally inextensible, flexible plastic article, open at one end (the upper end) and closed at the other end (the lower end), and has upper sidewalls means (or upper portion) 32 adjacent to the open end, and an elongated, regularly convoluted portion 34 which extends from the upper sidewall means 32 to the closed end. The lower part of convoluted portion 34 is tapered inwardly, and the liner 14 terminates in a blunted or rounded point 36 at its closed end.

The upper sidewall means 32 of liner 14 is devoid of pleats and comprises a frustoconical flange 38 at the open end, a pair of concentric cylindrical sections 40 and 42, the former being of larger diameter than the latter and being disposed closer to the open end, and a frustoconical transition section 44 linking the cylindrical sections 40 and 42. The smaller cylindrical section 42 may be provided with beads 46 as shown in FIG. 2A. if desired for gripping, as will be hereinafter described. However, beads 46 are not necessary for good frictional engagement between the liner 14 and the sleeve 16, and may be omitted. Cylindrical section 42 may be of very short axial length and can be omitted entirely, so that frustoconical section 44 is adjacent to the upper end of the convoluted portion 34.

Figure 3:
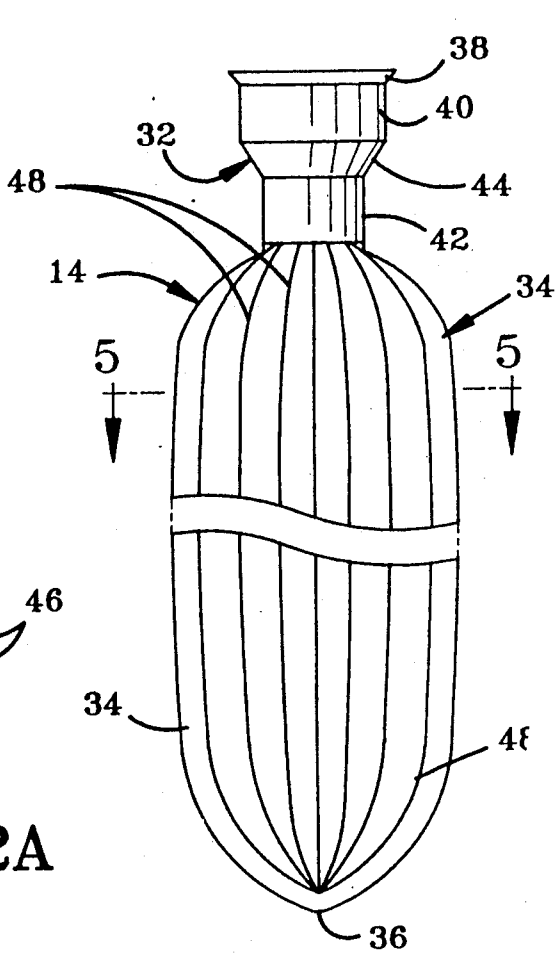
FIG. 3 is an elevational view of a liner according to this invention in its expanded state.
Figure 4:
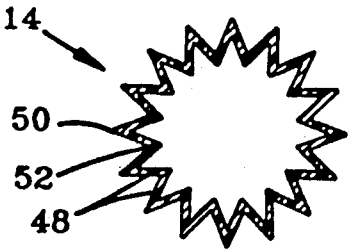
FIG. 4 is a cross-sectional view, taken along line 4—4 of FIG. 2, of a liner of this invention in its folded state.

Convoluted portion 34 comprises a plurality of longitudinally extending folds or convolutions 48, best seen in FIG. 4. These convolutions form alternating ridges 50 and valleys 52. The ridges and valleys are creased forming a permanent pleat. The ridges and valleys (except the end portions thereof) define a pair of concentric right circular cylinders. The ridges taper toward upper sidewall means 32 at the upper end of convoluted portion 34. This aids in avoiding trapping of material to be dispensed in this region. The valleys may either taper or not at the upper end of the convoluted portion 34. Both the ridges and valleys taper toward point 36 at the lower end. Thus, the greater part of the convoluted portion 34 (excluding the upper and lower ends thereof) is cylindrical and of uniform diameter. This cylindrical part of convoluted portion 34 constitutes a major portion of the overall length of liner 14. The contours of the peaks of pleats 48 when the liner 14 is in its normal or empty (i.e., non-pressurized) state may be seen in FIG. 2. FIG. 3 shows that contours of pleats 48 when the liner 14 is in its expanded or pressurized state (i.e., when filled with product to be dispensed).

The depth of convolutions or pleats 48 is essentially uniform in the cylindrical middle part of convoluted portion 34. The depth of the pleats 48 decreases at either end of convoluted portion 34 as one approaches either the upper sidewall means 32 (at the upper end) or the point (at the lower end). The depth of pleats 48 should be greater at the lower end than at the upper end for any given inner circle diameter (representing the diameter of the circle that connects the valleys). It is believed that this is beneficial in obtaining substantially complete expulsion of product from liner 14, as will be discussed in greater detail later.

The inner circle diameter of the convoluted portion 34 is preferably equal to or slightly greater than the inside diameter of cylindrical section 43 so that this cylindrical section 42 forms a neck portion of liner 14.

While the convoluted portion 34 as shown is a generally cylindrical configuration, it may assume other configurations, e.g., ellipsoidal or spherical. In any case, the preferred configurations are surfaces of revolution, and in all cases the convoluted portion has regular longitudinally extending convolutions, which are permanent pleats.

Liner 14 is made of a flexible plastic material, which may be either elastomeric or nonelastomeric, preferably non-elastomeric. A preferred material is high density polyethylene (HDPE); other suitable materials include polyamide and "Barex" 218, which is an acrylonitrile available from British Petroleum. Liner 14 is a free standing member, i.e., it is not integrally joined to any other part or component of the container 10. Liner 14 is flexible over its entire length, but is stiff enough to be self-supporting.

Figure 5:
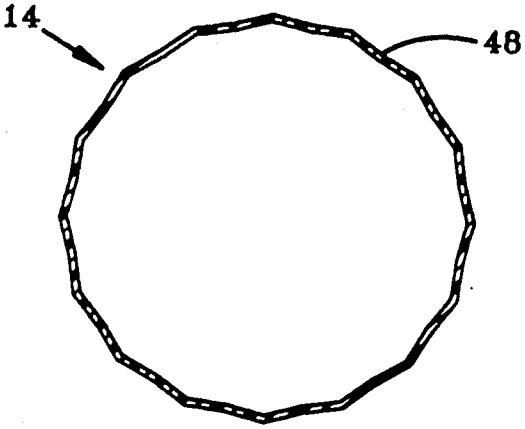
FIG. 5 is a cross-sectional view, taken along line 5—5 of FIG. 3, of a liner of this invention in its expanded state.

The liner may be of any suitable thickness, typically about 10 to 20 mils (0.010 to 0.020 inch) preferably about 0.012 to 0.018 inch. Except for the tapered portion near point 36, the liner should be of substantially uniform thickness over its entire length. (Minor variations in thickness, up to about 0.004 inch between the greatest and least thickness, are acceptable). The liner 14 is radially expandable by virtue of its folds or convolutions 48, even when it is made of a non-elastomeric material. Liner 14 is substantially inextensible in the longitudinal direction. A non-elastomeric liner having a thickness of 10–20 mils is inherently flexible; for example, it can be flexed or bent by hand. It is also inherently compressible, i.e., it can be squeezed in the radial direction by finger pressure applied by a person between the thumb and forefinger. At the same time, this thickness is sufficient so that the liner is selfsupporting, i.e., capable of holding the folded or convoluted shape shown in FIGS. 1, 2, 4 and 6 of the drawings when not under pressure and (because the plastic material forming the liner has memory) returning to that shape when stress is removed. When a fluid under pressure is introduced into the liner 14, it expands, assuming the configuration shown in FIGS. 3 and 5. The circumference or perimeter of the liner in its expanded form is nearly circular as may be seen in FIG. 5. FIG. 5 may represent an expanded liner 14 of this invention approximately in its actual size (typically 1.75 inch diameter)(or somewhat larger than actual size, as shown). The outer diameter of the liner in its folded form (measured between two diametrically opposite ridges 50) is about one-half the diameter in the expanded form.

The liner may be formed by conventional plastic molding techniques, preferably by blow molding. The liner is molded in its folded form as shown in FIGS. 2 and 4. Since the material forming the liner has memory, the liner will return to the folded form shown in FIG. 2 when no pressure or other stress is applied. This is important in order that the liner will have maximum effectiveness in expelling substantially the entire quantity of product contained in liner 14.

Figure 6:
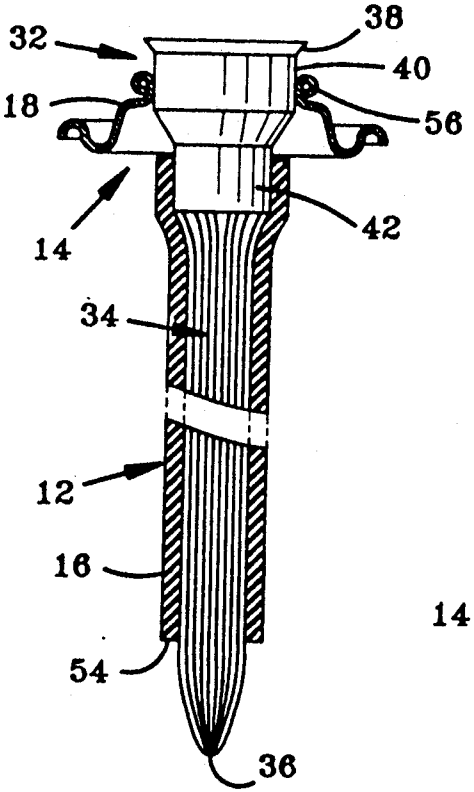
FIG. 6 is an elevational view, with part shown in longitudinal section, of a sub-assembly comprising a fluid dispensing assembly (or a liner/sleeve assembly) and a dome.

Liner 14 is placed inside a cylindrical elastomeric sleeve 16, which furnishes the energy required to dispense the product from liner 14, forming fluid dispensing assembly (or liner/sleeve assembly) 12. Sleeve 16 is a tube, open at both ends, which stores energy as liner 14 is filled with product under pressure and which releases that energy as product is dispensed from liner 14. The wall thickness of sleeve 16 must be sufficient for this purpose. Sleeve 16 in its unstressed state is a tube of uniform diameter over its entire length. The inside diameter of sleeve 16 in its unstressed state is substantially smaller than the outside diameter of liner 14 in its folded state. (The outside diameter of liner 14 in its folded state is the diameter as measured between two diametrically opposite ridges). The diameter of sleeve 16 is expanded slightly over most of its length as shown in FIG. 6, after insertion of liner 14. The axial length of sleeve 16 is less than that of liner 14. The upper sidewall means 32 of the liner protrudes from one end of the sleeve 16 and the tapered lower end of the liner (near point 36) protrudes from the other end of the sleeve, when the liner/sleeve assembly 12 is not under pressure. When the liner 14 is filled with product under pressure, sleeve 16 expands radially and elongates in the axial direction, assuming the outline shown in the phantom line in FIG. 1. The liner 14 expands radially, from the folded state shown in FIGS. 2 and 4 to the expanded state shown in FIGS. 3 and 5, while remaining at substantially its original length. When the liner 14 and sleeve 16 are so expanded, the lower end of sleeve 16 extends beyond the point 36 of liner 14, as may be seen in FIG. 1. Sleeve 16 should be at least about 25 percent longer in its pressurized and expanded state than in its normal or relaxed state when the aspect ratio of the liner 14 (which is the ratio of its length to its diameter in the expanded state) is at least 3. The percentage elongation required increases as the aspect ratio decreases. The liner will usually have an aspect ratio of at least 3 when its capacity is 12 ounces (340 grams) or less. Smaller aspect ratios are frequently preferred in larger containers.

The preferred elastomeric material for sleeve 16 is a synthetic rubber, and in particular Natsyn rubber. Natsyn rubber is cis-1,4-polyisoprene. A desirable characteristic of Natsyn rubber is that it is able to hold a high pressure per gram of material. Also, Natsyn rubber has less "die swell" than most rubbers, and considerably less than that of natural rubber. Rubbers tend to expand or swell dimensionally as they come out of the die, and "die swell" is the measure of this degree of swelling. Also, Natsyn rubber possesses the ability to elongate as well as expand radially when pressurized. The elastomeric material used to form sleeve 16 should exhibit both elongation and radial expansion when pressurized. The percentage elongation required will vary somewhat depending upon the aspect ratio of the sleeve 16, is noted above. Since some relative longitudinal movement between the sleeve and the liner occurs during filling and dispensing, as is apparent from FIG. 1, it may be desirable to include a lubricant additive in the elastomer composition forming liner 16, as is apparent to those skilled in the art.

Liner/sleeve assembly 12 preferably does not include any structural elements other than liner 14 and sleeve 16, and so preferably consists essentially of the liner 14 and the sleeve 16.

All references to size, dimensions and shape of liner 14 and sleeve 16 refer to the normal or unstressed state, i.e., when the liner and sleeve are not assembled into a liner/sleeve assembly 12 and each is surrounded by air at atmospheric pressure, unless otherwise stated.

Figure 7:
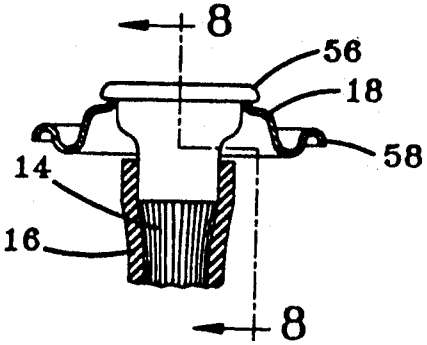
FIG. 7 is a fragmentary elevational view, with parts shown in section, of a portion of the subassembly of FIG. 6, shown in a later stage of assembly.

Referring now to FIG. 7, dome 18 is annular, may be bell-shaped as shown, has a central opening with a ring 56 around this central opening and also has a lip 58 extending around its circumference or outer edge and forming a locking device to accept an outside shell. Configuration of dome 18 may be substantially the same as that of the dome in a conventional aerosol container. Dome 18 is preferably metallic, and in any case should be essentially rigid and of sufficient strength to permit crimping of the outer edge or lip of cup 26 around ring 56, as will be hereinafter described. Similarly, cup 26 is preferably metallic and should be essentially rigid and sufficiently strong and resilient to permit crimping.

Figure 8:
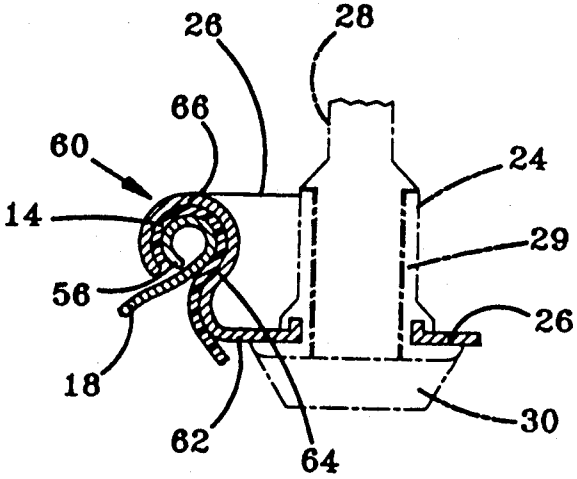
FIG. 8 is a vertical sectional view, taken along line 8—8 of FIG. 7, showing an enlarged detailed, not to scale, joint among the dome, liner and valve assembly of this invention.

FIG. 8 shows the top assembly 60 of a container 10 according to this invention, with parts broken away and parts drawn to an exaggerated scale. Dome 18 has a central opening and a ring 56 extending around the central opening as previously explained. Cup 26 comprises a flat circular disk-like portion 62 with a central opening for dispensing stem 28 and collar 29, and an upstanding sidewall 64 which is a surface of revolution. Sidewall 64 terminates at its upper (or outer) end in a rim 66. The upper edge or rim 66 of sidewall 64 is crimped against ring 56, with the upper part of the upper sidewall means 32 of liner 14 clamped between the crimped portion 66 of top sidewall 64 and the ring 56 of dome 18. This affords a fluid tight closure of the upper or open end of liner 14. Cup 26, stem 28, collar 29 and valve 30 together form valve assembly 24.

The configuration of the entire top assembly 60 of container 10, including valve assembly 24 and ring 18, but excluding liner 14, is quite similar to that of a conventional aerosol container, the exception being that the outside edge will accept and lock an outside shell of a non-metallic material. The top assembly herein is quite different from those shown in the above referenced U.S. Pat. Nos. 4,387,833 and 4,423,829.

A container can, according to this invention, may be assembled as follows:

First, a liner 14 in its normal folded state, as shown in FIG. 2, is inserted into a sleeve 16, also in its normal state, to form a fluid dispensing assembly (or liner/-sleeve assembly) 12 as shown in FIG. 6. A lubricant may be applied to either the outside surface of the liner or the inside surface of the sleeve to facilitate insertion. (This is usually not necessary when a lubricant additive is included in the compound forming sleeve 16). The upper end of sleeve 16 surrounds the upper portion, of liner 14, and preferably overlies cylindrical section 42 and is in frictional engagement therewith. The tapered end 36 of liner 14 extends beyond the adjacent end of sleeve 16. The gripper rings 46 (when present) grip the inside of the sleeve 16 near its upper end, as an aid in retaining the liner inside the sleeve. Normally, however, frictional engagement between sleeve 16 and the upper sidewall means 32 (and particularly cylindrical section 42 thereof) of liner 14 is sufficient so that rings 46 are not necessary.

Next, dome 18 is put in place. This is done by putting the liner/sleeve assembly, beginning at the end having the closed end 36 of line 14, through the central opening of the dome 18. This will bring the ring 56 into engagement with the larger cylindrical section 40 of upper sidewall means 32 of liner 14, as shown in FIG. 6. The outside diameter of section 40 is essentially the same as the diameter of the central opening of dome 18. The liner/sleeve assembly 12 is then gently pulled until ring 56 is in contact with flange 38 of liner 14.

Third, the valve assembly 24 with the sidewall 64 of cup 26 (not yet crimped) is put in place so that the upper edge or rim of cup sidewall 64 is substantially abreast of flange 38. Then the upper part of cup sidewall 64 is crimped against the ring 56 of dome 18, clamping the upper part of the upper sidewall means 32 of liner 14 (including flange 38 and part of cylindrical section 40) in between the cup sidewall 64 and the dome ring 56. The upper part of cup sidewall 64 is formed into a lip 66 in the crimping process.

Finally, any remaining housing components, such as outer shell or sidewall 20 and bottom wall 22 (which may be pre-assembled), are assembled into place. This may be done by conventional means. Alternatively, this sidewall 20 and bottom wall 22 may be preassembled with dome 18, in which case the entire assembly shown in FIG. 6, i.e., liner/sleeve assembly 12 and top assembly 60, including dome 18 and valve assembly 24, may be inserted into this housing pre-assembly.

A container 10 according to this invention is filled with a fluid product by pumping the fluid product in through stem 28 into liner 14, and continuing such pumping until the liner expands to the position shown in FIG. 5. The sleeve 16 expands radially simultaneously with the liner 14. Radial expansion will ordinarily commence in the lower portion of liner 14 (e.g., just above the tapered lower part of convoluted portion 34 and remote from the upper end of sleeve 16). Sleeve 16 also elongates axially as the liner 14 is filled. No slippage between the sleeve and the liner occurs at the upper end of the sleeve, but the remainder of the sleeve elongates. The length of liner 14 remains substantially the same, whether liner 14 is folded (as in FIG. 2) or expanded (as in FIG. 3). Expansion of the sleeve 16 causes it to store energy. When the liner/sleeve assembly 12 is in its fully expanded state (and during expansion as well), the stress exerted by the fluid product is borne by the sleeve 16. The liner 14 is substantially unstressed and so is capable of withstanding the application of pressure by the fluid product contained therein, despite its thinness.

A user who wishes to dispense product from container 10 then causes the valve 30 to open in a conventional way, e.g., by tilting or depressing stem 28. When the user wishes to stop the flow of product, he or she lets go of stem 28, allowing it to return to its upright position, whereupon valve 30 closes and flow of product stops. This can continue until the product is exhausted. The motive power for dispensing is furnished by the energy stored in sleeve 16. As product is dispensed, the liner 14 and the sleeve 16 gradually return to their original (unstressed) shape as shown in FIG. 6 reaching that shape when substantially all of the product has been dispensed. The upper end of sleeve 16 remains in position surrounding the upper portion of liner 14 with no slippage in this area as the liner size sleeve assembly 12 returns to its normal position. The pressure curve of sleeve 16 herein (i.e., the ratio of either percentage of radial expansion or percentage elongation to pressure applied) is substantially flat.

Substantially complete dispensing of the product is possible, since the liner 14 by virtue of memory returns to its folded position shown in FIGS. 2 and 4; furthermore, sleeve 16 contains enough stored energy, even when the liner sleeve assembly has nearly returned to its normal position (FIG. 6), to expel product.

The container of this invention has several advantages over conventional aerosol containers. First, no propellant is required. The safety and environmental hazards associated with aerosol propellants are eliminated. Secondly, filling and storage are at lower pressures than is the case in the conventional aerosol container. Filling of a container of this invention is less costly than filling of an aerosol container, because the costs of necessary safety equipment and insurance costs are both reduced. Similarly, insurance costs during transportation are less. Finally, the container of this invention can be incinerated safely; it is at virtually atmospheric pressure when exhausted and therefore will not explode and there are no toxic combustion products. The container herein has the additional advantage of being refillable or reusable and has recyclable components. A container of this invention has the advantage over previously known self-pressurized containers in that a greater proportion of the product contained therein is expelled. Expulsion of product is substantially complete in containers of this invention, while appreciable quantity of product remains in previously known self-pressurized containers when the container has been emptied as far as possible. Furthermore, the fluid tight joint between valve assembly and liner is superior to the joint between the valve assembly and liner in previously known self-pressurized containers, such as those in the Venus and Katz patents. This invention has the advantage of material versatility in the liner, and because a standard aerosol valve is being used, thousands and thousands of combinations are available between valve and spray head design.

While this invention has been described with reference to the best mode and preferred embodiment thereof, it is understood that this description is by way of illustration and not by way of limitation.

What is claimed is:

1. A fluid dispensing assembly for a self-pressurized container, said assembly comprising:

(a) an elongated radially expandable generally cyclindrical flexible plastic liner open at one end and closed at the other end, said liner being of sufficient thickness to be self-supporting in the unstressed state and having upper sidewall means adjacent to the open end and a regularly convoluted portion comprising a plurality of longitudinally extending convolutions extending from said upper sidewall means towards the closed end, said liner having an outwardly turned flange at the open end thereof, said liner having an essentially uniform thickness in the range of about 0.010 inch to about 0.020 inch over its entire length except optionally adjacent to the closed end; and (b) an essentially cylindrical elastomeric sleeve open at both ends and surrounding at least a major portion of said liner in close fitting relationship, with no structural element between said liner and said sleeve, the normal inside diameter of said sleeve being substantially smaller than the exterior diameter of the liner in its folded state, said sleeve being free to elongate axially and having an axial length at least about 25% greater in the pressurized state than in the non-pressurized state.

2. A fluid dispensing assembly according to claim 1 wherein the normal inside diameter of said sleeve is substantially less than the expanded diameter of said liner.

3. A fluid dispensing assembly according to claim 1 wherein the axial length of said sleeve in the unstressed state is less than that of said liner and the axial length of said sleeve in the pressurized state is greater than that of said liner.

4. A fluid dispensing assembly according to claim 1 wherein said convoluted portion comprises an essentially cylindrical middle portion and a tapered bottom portion adjacent to said closed end and disposed below said middle portion, said upper sidewall means and said essentially cylindrical portion being of essentially uniform thickness in the range of about 0.010 inch to about 0.020 inch.

5. A fluid dispensing assembly according to claim 1 further including a lubricant applied to one of the inside surfaces of said sleeve and the outside surface of the liner.

6. A fluid dispensing assembly according to claim 1 wherein said liner is formed in the folded state wherein said convolutions are present and has memory, whereby said liner returns to the folded state when unstressed.

7. A fluid dispensing assembly according to claim 6 wherein said liner is non-elastomeric.

8. A fluid dispensing assembly according to claim 6, said fluid dispensing assembly consisting essentially of said liner and said sleeve.

9. A self-pressurized container comprising:

(a) a liner/sleeve assembly comprising (1) an elongated radially expandable generally cylindrical flexible plastic liner open at one end and closed at the other end, said liner being of sufficient thickness to be self-supporting in the unstressed state and having upper sidewall means adjacent to the open end and a regularly convoluted portion comprising a plurality of longitudinally extending convolutions extending from said neck portion toward the closed end, said liner having an outwardly turned flange at the open end thereof, said liner having an essentially uniform thickness in the range of about 0.010 inch to about 0.020 inch over its entire length except optionally adjacent to the closed end;

(2) an essentially cylindrical elastomeric sleeve open at both ends and surrounding at least a major portion of said liner in tight fitting relationship, with no structural element between said liner and said sleeve the normal inside diameter of said sleeve being substantially smaller than the exterior diameter of the liner in its folded state, said sleeve being free to elongated axially and having an axial length at least about 25% greater in the pressurized state than in the non-pressurized state;

(b) a housing comprising a sidewall and an essentially rigid annular dome, said dome having a central opening and a ring surrounding said opening; and (c) a valve assembly including a valve for dispensing fluid material from the interior of said plastic liner, an essentially rigid cup having an upstanding sidewall and a vertical tubular stem for discharge of said fluid material, the upper portion of the sidewall of said cup including said flange being crimped against the ring of said dome with the open end of said liner being clamped therebetween.

10. A container according to claim 9 wherein said cup and said dome are metallic.

11. A container according to claim 9 wherein said liner is non-elastomeric.

12. A container according to claim 9 wherein said liner is formed in the folded state wherein said convolutions are present and has memory, whereby said liner returns to the folded state when unstressed, and said convolutions form peaks and valleys wherein a crease is formed as a permanent pleat at each peak and valley.

13. A container according to claim 9 wherein the normal axial length of said sleeve is less than that of said liner and the expanded axial length of said sleeve is greater than that of said liner.

14. A container according to claim 9 wherein said convoluted portion comprises an essentially cylindrical middle portion greater than half the total length thereof and a tapered bottom portion adjacent to said closed end and disposed below said middle portion, said upper sidewall means and said essentially cylindrical portion being of essentially uniform thickness in the range of about 0.010 inch to about 0.020 inch.

15. A container according to claim 9, further including a lubricant applied to one of the inside surface of said sleeve and the outside surface of the liner.

16. A method for making a self-pressurized container which comprises:

(a) molding a moldable material essentially the same thickness throughout, into an elongated generally cylindrical self-supporting flexible liner open at one end and closed at the other end and having, as molded upper sidewall means adjacent to the open end, an outwardly turned flange at the opened and a regularly convoluted portion comprising a plurality of longitudinally extending convolutions extending from said upper sidewall means towards the closed end said liner as molded having an essentially uniform thickness in the range of about 0.010 inch to about 0.020 inch over its entire length except optionally adjacent to the closed end thereof;

(b) inserting said liner into an elastomeric sleeve with no structural element between said liner and said sleeve, said sleeve having an inside diameter substantially smaller than the exterior diameter of the liner in its folded state and an axial length less than that of said liner, so that the upper sidewall means and the closed end of said liner protrude from said sleeve when both said liner and said sleeve are in the non-pressurized state, said sleeve being free to elongate axially and having an axial length at least about 25% greater in the pressurized state than in the non-pressurized state;

(c) placing an annular essentially rigid dome having a central opening and a ring encircling said opening so that said ring is in touching engagement with the outside surface of the upper sidewall means;

(d) placing a valve assembly which includes a metal cup having a bottom portion and an upstanding sidewall means, so that said cup is in contact with the inside surface of the upper sidewall means of said liner;

(e) crimping the upper edge of the sidewall means of said cup against said ring, with the part of the upper sidewall means of said liner clamped therebetween as a gasket material to form a fluid tight seal between said cup and said liner; and (f) assembling any remaining housing components to form said container.

17. A method according to claim 16 wherein said convoluted portion comprises an essentially cylindrical middle portion and a tapered bottom portion adjacent to said closed end and disposed below said middle portion, said upper sidewall means and said essentially cylindrical portion being of essentially uniform thickness in the range of about 0.010 inch to about 0.020 inch.

18. A method according to claim 16 wherein a lubricant is applied to the inside surface of said sleeve or the outside surface of said liner prior to insertion of said liner.

* * * * *

US005111971A

REEXAMINATION CERTIFICATE (2055th)

United States Patent [19]

Winer

[11] B1 5,111,971

[45] Certificate Issued Jul. 6, 1993

[54] SELF-PRESSURIZED CONTAINER HAVING A CONVOLUTED LINER AND AN ELECTROMETRIC SLEEVE

[75] Inventor: Robert Winer, Akron, Ohio

[73] Assignee: Akron Polymer Container Corporation, Akron, Ohio

Reexamination Request:
No. 90/002,769, Jun. 26, 1992

Reexamination Certificate for:

| | |
|---|---|
| Patent No.: | 5,111,971 |
| Issued: | May 12, 1992 |
| Appl. No.: | 646,621 |
| Filed: | May 25, 1990 |

[22] PCT Filed: May 25, 1990

[86] PCT No.: PCT/US90/03062

§ 371 Date: Jan. 28, 1991

§ 102(e) Date: Jan. 28, 1991

[87] PCT Pub. No.: WO90/14284

PCT Pub. Date: Nov. 29, 1990

Related U.S. Application Data

[63] Continuation-in-part of Ser. No. 358,392, May 26, 1989, abandoned.

[51] Int. Cl.[5] ..... B65D 35/28

[52] U.S. Cl. ..... 222/95; 222/105; 222/183; 222/386.5; 29/888.01

[58] Field of Search ..... 222/95, 105, 386.5, 222/183, 405, 402.1, 402.26; 29/888.01

[56] References Cited

U.S. PATENT DOCUMENTS

| | | | |
|---|---|---|---|
| 3,731,854 | 5/1973 | Casey | 222/95 X |
| 4,251,032 | 2/1981 | Werding | 222/386.5 X |
| 4,387,833 | 6/1983 | Venus, Jr. | 222/95 |
| 4,423,829 | 1/1984 | Katz | 222/95 |

OTHER PUBLICATIONS

"Packaging" magazine, May 1987 issue, p. 14.

"Packaging" magazine, Sep. 1987 issue, *Packaging's 1987 Awards.*

"Packaging" magazine, Oct. 1987 issue, p. 14.

"Food Packaging" magazine, May 1988, p. 7.

"Manufacturing Chemist" magazine, Dec. 1988 issue, p. 11.

"Soap Cosmetics Chemicals" magazine, Nov. 1988 issue, pp. 28, 29, 30, 64.

"Food & Drug Packaging" magazine, Aug. 1985, pp. 3, 50.

"Food & Drug Packaging" magazine, Dec. 1985, vol. 49, Issue No. 12.

"Collapsible Tubes," *Manufacturing Chemist* (Jun. 1987).

*Primary Examiner*—Andres Kashnikow

[57] ABSTRACT

Self-pressurized container which comprises a liner/-sleeve assembly containing a thin, flexible radially expandable convoluted plastic liner, about 0.010 to about 0.020 inch thick, inside an essentially cylindrical elastomeric sleeve. The liner is generally cylindrical, open at one end and closed at the other end, and comprises an outwardly turned flange and an upper sidewall adjacent to the open end and a convoluted portion comprising longitudinally extending convolutions which extend from the upper sidewall towards the closed end. The liner is formed in the convoluted state, and has memory so that it returns to the convoluted state when unstressed. The outside diameter of the liner, measured between diametrically opposite peaks of the convolutions when the liner is unstressed, exceeds the inside diameter of the elastomeric sleeve when unstressed. Both liner and sleeve expand radially outwardly when the liner is filled under pressure with product to be dispensed. The liner/sleeve assembly is capable of holding a substantial quantity of fluid product and of causing substantially all of said product to be dispensed. The top assembly of the container is similar to that of a conventional aerosol container, comprising a valve assembly with a metallic cup whose rim is crimped around a ring surrounding a central opening of a metallic dome, but with a part of the upper sidewall of the liner clamped between the cup and the dome ring as a gasket to form a fluid tight closure for the liner.

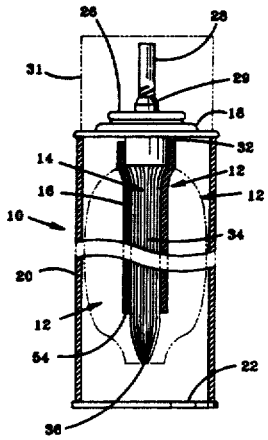

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–8 and 16–18 is confirmed.

Claim 9 is determined to be patentable as amended.

Claims 10–15, dependent on an amended claim, are determined to be patentable.

9. A self-pressurized container comprising:

(a) a liner/sleeve assembly comprising (1) an elongated radially expandable generally cylindrical flexible plastic liner open at one end and closed at the other end, said liner being of sufficient thickness to be self-supporting in the unstressed state and having upper sidewall means adjacent to the open end and a regularly convoluted portion comprising a plurality of longitudinally extending convolutions extending from said [neck portion] *upper sidewall means* toward the closed end, said liner having an outwardly turned flange at the open end thereof, said liner having an essentially uniform thickness in the range of about 0.010 inch to about 0.020 inch over its entire length except optionally adjacent to the closed end;

(2) an essentially cylindrical elastomeric sleeve open at both ends and surrounding at least a major portion of said liner in tight fitting relationship, with no structural element between said liner and said sleeve, the normal inside diameter of said sleeve being substantially smaller than the exterior diameter of the liner in its folded state, said sleeve being free to elongated axially and having an axial length at least about 25% greater in the pressurized state than in the non-pressurized state;

(b) a housing comprising a sidewall and an essentially rigid annular dome, said dome having a central opening and a ring surrounding said opening; and (c) a valve assembly including a valve for dispensing fluid material from the interior of said plastic liner, an essentially rigid cup having an upstanding sidewall and a vertical tubular stem for discharge of said fluid material, the upper portion of the sidewall of said cup including said flange being crimped against the ring of said dome with the open end of said liner being clamped therebetween.

* * * * *